US005570077A

United States Patent [19]

Swieboda

[11] Patent Number: 5,570,077

[45] Date of Patent: Oct. 29, 1996

[54] AMBIENT CONDITION DETECTOR WITH HIGH INTENSITY STROBE LIGHT

[75] Inventor: Michael A. Swieboda, Naperville, Ill.

[73] Assignee: BRK Brands, Inc., Aurora, Ill.

[21] Appl. No.: 426,216

[22] Filed: Apr. 21, 1995

Related U.S. Application Data

[63] Continuation of Ser. No. 65,222, May 20, 1993, abandoned.

[51] Int. Cl.[6] ..... G08B 5/00

[52] U.S. Cl. ..... 340/331; 340/628; 340/693; 315/241 P; 315/241 R; 315/241 S

[58] Field of Search ..... 340/331, 628, 340/531, 693; 315/129, 130, 210, 241 R, 241 P, 241 S

[56] References Cited

U.S. PATENT DOCUMENTS

| | | | |
|---|---|---|---|
| 3,822,393 | 7/1974 | Karpol | 315/241 P |
| 4,283,657 | 8/1981 | Gordon et al. | 315/86 |
| 4,459,005 | 7/1984 | Harvey | 354/403 |
| 4,754,416 | 6/1988 | Adams et al. | 340/985 |
| 4,763,114 | 8/1988 | Cota | 340/628 |
| 4,900,990 | 2/1990 | Sikora | 315/241 P |
| 4,952,906 | 8/1990 | Buyak et al. | 340/331 |
| 5,016,038 | 5/1991 | Kobayashi et al. | 354/418 |
| 5,019,805 | 5/1991 | Curl et al. | 340/628 |
| 5,128,591 | 7/1992 | Bocan | 315/241 S |
| 5,177,461 | 1/1993 | Budzyna et al. | 340/331 |
| 5,250,977 | 10/1993 | Tanaka | 315/241 P |
| 5,293,242 | 3/1994 | Mamiya | 354/80 |
| 5,400,008 | 3/1995 | Toohey | 340/331 |

FOREIGN PATENT DOCUMENTS

A73931/87 12/1987 Australia .

OTHER PUBLICATIONS

Frynetics Inc./Ventek, Inc., Visual Alert Product Brochure—4 pages.

Maple Chase, Firex Smoke Alarms Catalog Insert—1 page.

Whelen Engineering Company, SD/VSA Product Information Brochure—2 pages.

Canterbury, *Elektro*, 10:776 (1904)—1 page.

*Primary Examiner*—Thomas Mullen

*Assistant Examiner*—Benjamin C. Lee

*Attorney, Agent, or Firm*—Dressler, Goldsmith, Milnamow & Katz, Ltd.

[57] ABSTRACT

A drive circuit for use with an ambient condition detector limits heat dissipation and associated temperature rises in the presence of varying RMS values of an applied AC signal. The drive circuit includes a voltage doubler with a current regulator located between first and second storage elements. In the presence of a sensed ambient condition, which exceeds a predetermined threshold the regulator is enabled permitting one of the storage elements to be charged to a voltage on the order of twice the peak value of the applied AC voltage. A digital timer is used to trigger a flashable visual indicator from the stored DC voltage. The regulator provides a substantially constant DC voltage to the visual indicator in the presence of a varying AC line voltage.

10 Claims, 1 Drawing Sheet

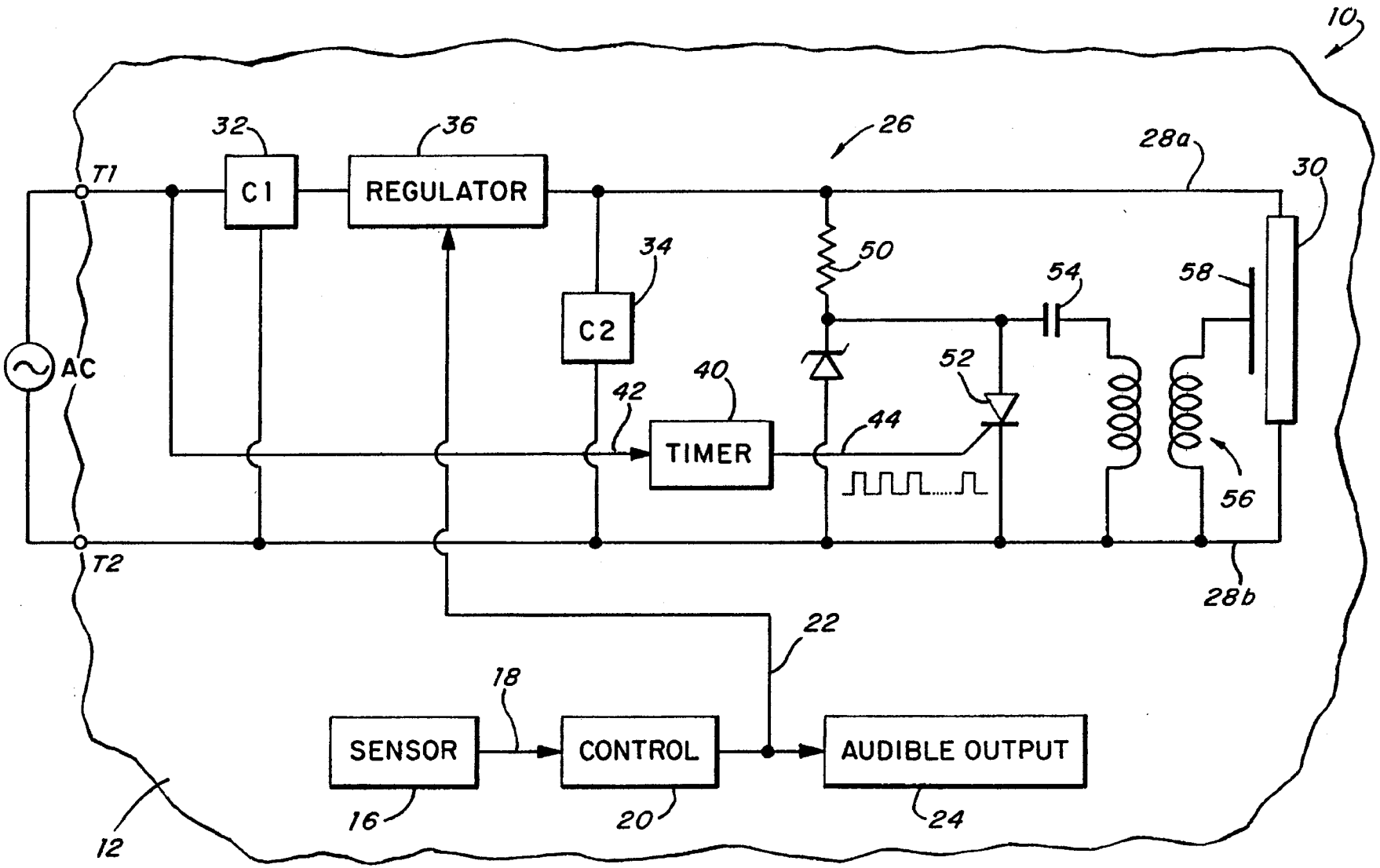
10
30
28a
28b
58
56
54
52
26
50
44
40
TIMER
34
C2
42
36
REGULATOR
32
C1
T1
T2
AC
22
AUDIBLE OUTPUT
24
CONTROL
20
18
SENSOR
16
12

AMBIENT CONDITION DETECTOR WITH HIGH INTENSITY STROBE LIGHT

This application is a continuation of application Ser. No. 08/065,222, filed May 20, 1993, abandoned Apr. 25, 1995.

FIELD OF THE INVENTION

The invention pertains to smoke or gas detectors usable to provide an alarm when a selected condition exceeds a predetermined threshold. More particularly, the invention pertains to such detectors which produce as an alarm indicium a high intensity light.

BACKGROUND OF THE INVENTION

There has been of late interest in smoke or gas detectors which provide visual alarm indicators as well as audible alarm indications. For example, it has been recognized that hearing impaired individuals may not hear a normal fire or smoke alarm. This is especially the case when such individuals are sleeping.

It has been known to couple high intensity strobe lights to smoke detectors so as to provide a visual output. Known circuits for driving such strobe lights, such as xenon tubes, have suffered from both variations in flash rate and also unwanted heat dissipation in response to variations in applied AC electrical energy.

It would be desirable to be able to limit the extent of heat dissipated in such circuits, along with associated temperature increases, in spite of increases in applied AC line voltage. Additionally, it would be desirable to maintain a constant flashing rate in the presence of variable applied AC voltage and also to provide a uniform degree of illumination from the strobe light notwithstanding such voltage variations.

SUMMARY OF THE INVENTION

A drive circuit usable to drive a strobe light includes a voltage doubler having first and second energy storage elements. The energy storage elements are coupled together by a regulator circuit. A strobe light, for example a high intensity flash tube, filled with an ionizable gas, is coupled across the second storage element.

A digital timer is provided which is driven off of an applied AC voltage. The timer provides a pulse train wherein the pulses are spaced apart a constant predetermined amount based on the frequency of the applied AC signal. Output from the timer drives a trigger circuit for energizing the strobe light hence initiating a flash cycle.

An ambient condition sensor is provided in the unit with an output which is indicative of a level of a predetermined characteristic of the ambient atmosphere. The sensor, in turn, provides an input to a control circuit.

The control circuit compares the sensor output to a predetermined reference. When the sensor output crosses the predetermined reference, the regulator between the first and second storage elements is enabled-by the control circuit.

The applied peak AC voltage is then substantially doubled and stored on the second storage element. When the next pulse from the timer arrives at the trigger circuit, the output strobe light is energized by the electrical energy stored on the second storage element. This in turn produces a high intensity visible output pulse of light indicative of the presence of an alarm condition.

The sensor can be a smoke sensor, such as an ionization or a photoelectric type sensor. Alternately, the sensor could detect a predetermined gas.

The visual output device could be a xenon flash tube or any other high intensity flashable visual output element which can be used to visually indicate the presence of an alarm condition.

These and other aspects and attributes of the present invention will be discussed with reference to the following drawing and accompanying specification.

BRIEF DESCRIPTION OF THE DRAWING

FIG. 1 is a block diagram of an ambient condition detector in accordance with the present invention.

DETAILED DESCRIPTION OF THE PREFERRED EMBODIMENT

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

A detector 10, in accordance with the present invention can be energized off an AC supply which is coupled to terminals T1 and T2. The detector 10 is carried by a housing 12.

The housing 12 carries an ambient condition sensor 16. Representative sensors include ionization or photoelectric-type smoke sensors. Alternatively, the sensor 16 can sense a predetermined gas such as carbon monoxide. The type of sensor is not a limitation of the present invention.

An electrical output from the sensor 16, provided on line 18 is an input to a control circuit 20. The control circuit 20 could include a detector integrated circuit such as a Motorola MC145011 type integrated circuit usable in photoelectric smoke detectors. Other integrated circuits could be used with the detector 10. It will be understood that neither the particular integrated circuit nor the ambient condition being sensed are limitations of the present invention.

The control circuit 20 compares the electrical signal on the line 18 to a predetermined reference and as a result of that comparison, produces an alarm condition indicating output on a line 22 when the ambient condition crosses the threshold. The signal on the line 22 can energize an audible output device such as a horn 24. The line 22 is also coupled to a drive circuit 26.

Output from the drive circuit 26 on a pair of lines 28A and 28B is coupled to a strobe light, such as a xenon flash tube 30. The tube 30 when driven, provides high intensity pulses of visual light suitable for visually indicating an alarm condition.

Flash tubes filled with gases other than xenon can be used without departing from the spirit and scope of the present invention. In addition, alternate high intensity pulsed light sources could be used instead of tubes filled with ionizable gases without departing from the spirit and scope of the present invention.

The drive circuit 26 includes first and second capacitive storage elements 32 and 34. A voltage regulator circuit 36 couples the first storage element 32 to the second storage element 34. The regulator circuit 36 operates in response to the electrical signal on the line 22 from the control unit 20.

When the regulator 36 is enabled in response to the electrical signal on the line 22, the storage elements 32 and 34 function as a voltage doubler. The peak AC voltage applied to terminals T1 and T2 essentially is doubled on capacitive storage element 34 in response to the regulator 36 being enabled. Hence, in the absence of an alarm condition, the element 34 is not fully charged.

The detector 10 also includes a digital timer 40 which receives clock input signals from the AC input on a line 42. The output from the timer 40 on a line 44 is a train of pulses which are spaced apart from one another a predetermined amount.

The pulse interval spacing is set by the frequency of the applied AC voltage as well as the configuration of the timer 40. In an exemplary embodiment, the pulses on the line 44 could, for example, be spaced apart from one another on the order of one second.

The drive circuit 26 also includes a current limiting resister 50, a silicone controlled rectifier 52 and a trigger capacitor 54.

The trigger capacitor 54 is in turn coupled to a primary of step-up transformer 56. A secondary of the transformer 56 is coupled to a trigger input 58 of the strobe 30.

When the signal on the line 22 indicates that the sensed ambient condition has exceeded the predetermined threshold the regulator 36 is enabled. In response to enabling the regulator 36, the voltage doubler, which includes the capacitive storage elements 32 and 34 produces a DC voltage across the capacitor bank 34 which has a value on the order of twice the peak voltage of the AC applied at the terminals T1 and T2. This stored DC voltage is in turn applied across the flash tube 30 via lines 28A and 28B.

The tube 30 is not flashed by the voltage applied from the capacitor bank 34. Rather, when the timer 40 produces the next output signal on the line 44, the silicon controlled rectifier 52 is turned on which in turn, grounds the capacitor 54.

The capacitor 54, previously charged, applies a voltage across the primary of the transformer 56. The transformer 56 in turn produces a stepped-up voltage on the secondary thereof, which in turn is coupled to the pulse input 58 of the strobe 30. This pulse input from the transformer 56 then causes the tube 30 to flash thereupon discharging the electrical energy stored in the capacitive bank 34.

The voltage doubler, elements 32 and 34, then restores the DC voltage across the capacitive element 34, assuming the signal on the line 22 continues to indicate that the ambient condition exceeds the predetermined threshold. When the next pulse arrives on the line 44 from the timer 40, the flashing process is repeated.

The process will continue to repeat until the signal on the line 22 indicates an absence of the predetermined condition at which time the regulator 36 will be disabled. The capacitive element 34 will no longer be recharged so as to be able to flash the strobe 30 even in the presence of pulses on the line 44.

The drive circuit 26 is particularly advantageous in that as the RMS AC voltage at terminals T1 and T2 varies, say in a range of between 96 V to 130 V RMS, the peak DC voltage which is produced across the capacitive storage element 34 remains substantially constant, on the order of 240 V DC as limited by regulator 36. This in turn, limits the added heat which is potentially generated due to higher end AC input voltages while at the same time ensuring that an adequate strobe discharge voltage will be developed across the storage element 34 in the presence of lower end AC input values. The temperature rise exhibited by the circuit 26 and strobe 30 is also limited.

The digital timer 40 produces an output pulse train which has a constant frequency even in the presence of varying RMS values of the applied AC input voltage. This produces a constant flashing frequency. Finally, the substantially constant level of the voltage produced across the capacitive element 34 before each flash cycle results in a substantially constant intensity of output light from the tube 30 in the presence of variable RMS values of the applied AC voltage.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An ambient condition detector with a visual output comprising:

a housing;

a condition sensor carried on said housing;

a control circuit coupled to said sensor wherein said circuit provides a control electrical signal on a selected output line indicative of a predetermined sensed, ambient condition;

a high intensity visual output device carried by said housing;

a drive circuit coupled to said control circuit and to said visual output device wherein said drive circuit includes a first energy storage device operatively connected to an AC power supply and a second energy storage device with a regulator circuit coupled therebetween, wherein said regulator circuit is coupled to said output line and wherein said regulator circuit is enabled by said control signal thereby fully charging said second storage device with sufficient energy to energize said high intensity output device at spaced apart time intervals thereby providing a high intensity indicium of said predetermined condition, said drive circuit including a digital timer for establishing said time intervals, wherein said visual output device is coupled across said second storage device and said second storage device is not fully charged absent said control signal that enables said regulator circuit.

2. A detector as in claim 1 wherein said visual output device includes an ionizable gas.

3. A detector as in claim 1 wherein said drive circuit includes a semiconductor switching element coupled between said regulator circuit and said visual output device.

4. A detector as in claim 1 including first and second input terminals coupled to said drive circuit for receiving an AC type input in a range of 90–140 V RMS.

5. A detector as in claim 4 wherein said drive circuit constitutes a voltage doubler circuit and wherein said visual output device is energized by a substantially constant potential in the presence of a variable AC-type input.

6. An ambient condition detector with a triggerable strobe light, comprising:

a voltage doubler which includes a regulator circuit which has an input port, an output port, and a control port, a first capacitor coupled between an AC power source and said input port, and a second capacitor coupled to said output port; and circuitry for detecting the presence of a predetermined ambient condition and for producing an electrical signal indicative thereof wherein said signal is coupled to said control port thereby enabling said regulator circuit for as long as the predetermined condition is present, and wherein said regulator, only when enabled, permits said second capacitor to be fully charged to energize the strobe light when the light is triggered.

7. A detector as in claim 6 which includes a source of trigger pulses of a predetermined period wherein said trigger pulses are coupled to the triggerable strobe light and wherein the strobe light will flash once each said period in response to said regulator circuit being enabled.

8. An ambient condition detector with a visual output comprising:

a housing;

a condition sensor carried on said housing;

a control circuit coupled to said sensor wherein said circuit provides a control signal indicative of a predetermined, sensed, ambient condition;

a regulator circuit carried on said housing, coupled to said control circuit, and enabled only in the presence of said control signal;

first energy storage element operatively connected to a source of varying electrical signals of a predetermined frequency and a second energy storage element wherein said regulator circuit is coupled therebetween, wherein a predetermined illumination producing quantity of energy is stored in said second storage element only while said regulator circuit is enabled;

a visual output device coupled across said second storage element; and a trigger circuit, coupled to said output device wherein said trigger circuit is operatively connected to said source of varying electrical signals of a predetermined frequency for triggering said output device when said second storage element has stored said illumination producing quantity of energy.

9. A detector as in claim 8 wherein a timer is coupled between said source of varying electrical signals and said trigger circuit.

10. A detector as in claim 8 wherein said regulator circuit and said energy storage elements form a voltage doubler.

* * * * *